US009725900B2

(12) United States Patent
Correia et al.

(10) Patent No.: US 9,725,900 B2
(45) Date of Patent: Aug. 8, 2017

(54) BUILDING BLOCKS AND REAR INTERLOCK CONNECTOR THEREFOR

(71) Applicant: Horacio Correia, Terrebonne (CA)

(72) Inventors: Horacio Correia, Terrebonne (CA); Simon Jean, Terrebonne (CA); Liborio Correia, Lorraine (CA)

(73) Assignee: Horacio Correia, Terrebonne (QC) (CA)

( * ) Notice: Subject to any disclaimer, the term of this patent is extended or adjusted under 35 U.S.C. 154(b) by 0 days.

(21) Appl. No.: 14/592,836

(22) Filed: Jan. 8, 2015

(65) Prior Publication Data

US 2015/0247328 A1 Sep. 3, 2015

Related U.S. Application Data

(60) Provisional application No. 61/925,163, filed on Jan. 8, 2014.

(51) Int. Cl.

| | |
|---|---|
| ***E04B 2/08*** | (2006.01) |
| ***E04C 1/00*** | (2006.01) |
| ***E02D 29/02*** | (2006.01) |
| ***E04B 2/32*** | (2006.01) |
| ***E04C 1/39*** | (2006.01) |

(Continued)

(52) U.S. Cl.

CPC ..... *E04C 1/00* (2013.01); *E02D 29/0266* (2013.01); *E04B 2/08* (2013.01); *E04B 2/32* (2013.01); *E04B 2/46* (2013.01); *E04C 1/395* (2013.01); *E04B 2002/0243* (2013.01); *E04B 2002/0252* (2013.01)

(58) Field of Classification Search

CPC ..... E04B 2/08; E04B 2002/0243; E04B 2/46; E04B 2002/0252; E04B 2/32; E04C 1/00; E04C 2/38; E04C 2/44; E04C 1/395; E02D 29/0241; E02D 29/0266

See application file for complete search history.

(56) References Cited

U.S. PATENT DOCUMENTS 2,392,551 A * 1/1946 Roe ..... E04B 2/08 52/309.17
4,532,747 A * 8/1985 Koetje ..... B63B 3/18 29/507

(Continued)

FOREIGN PATENT DOCUMENTS

DE 102007044017 A1 * 3/2009 ..... E04B 2/18

*Primary Examiner* — Adriana Figueroa
*Assistant Examiner* — Jessie Fonseca
(74) *Attorney, Agent, or Firm* — Praxis & Equinox IP; Franz Bonsany

(57) ABSTRACT

An interlock connector interlocks building blocks that are assembled so as to provide a wall structure. The building blocks have respective front surfaces for defining a front façade of the wall structure and respective rear surfaces with at least one respective horizontal groove. The interlock connector comprises first and second bodies. The first body is inserted in the rear surface horizontal groove of a first building block. The second body is inserted in the rear surface horizontal groove of a second building block adjacent the first building block. Insertion of the first and second bodies in the respective rear surface horizontal grooves of the first and second building blocks provides for interlocking the first and second building blocks.

9 Claims, 19 Drawing Sheets

(51) Int. Cl.
*E04B 2/46* (2006.01)
*E04B 2/02* (2006.01)

(56) References Cited

U.S. PATENT DOCUMENTS 4,824,293 A * 4/1989 Brown ..... E02D 29/0241 405/262
4,833,856 A * 5/1989 Zwagerman ..... B63B 35/38 446/122
4,922,678 A * 5/1990 Scheiwiller ..... E01F 8/0082 52/570
5,178,492 A * 1/1993 Meheen ..... E02D 29/025 405/262
5,315,802 A * 5/1994 Hart ..... E04B 2/08 52/426
5,735,643 A * 4/1998 Castonguay ..... E02D 29/0266 405/284
6,024,517 A * 2/2000 Castonguay ..... E02D 29/0266 125/2
2010/0018146 A1* 1/2010 Aube ..... E02D 29/0233 52/483.1
2010/0284751 A1* 11/2010 Price ..... E04C 1/395 405/284
2011/0000161 A1* 1/2011 Aub ..... E04B 2/46 52/563

* cited by examiner

BUILDING BLOCKS AND REAR INTERLOCK CONNECTOR THEREFOR

CROSS-REFERENCE TO RELATED APPLICATIONS

The present application claims priority on U.S. Patent Application No. 61/925,163 filed on Jan. 8, 2014 and incorporated herein in its entirety.

TECHNICAL FIELD

The present disclosure relates to building blocks such as cementitious blocks and the like. More particularly, but not exclusively, the present disclosure relates to building blocks and rear interlock connectors therefor.

BACKGROUND

Outdoor landscaping wall systems such as retaining wall structures comprised of stacked and interlocked precast concrete building blocks are well known. It is common to vertically stack such blocks in horizontal courses, wherein an upper course is offset with respect to the next lower course, so as to provide a retaining wall having a desired inclination. Usually, such blocks are provided with grooves on their top and bottom faces. In this way, interlock connectors can be interposed between two stacked building blocks and fitted in the grooves.

An inconvenience of current wall systems is that the blocks need to interlocked as they are being stacked rather than locked after they are stacked.

OBJECTS

An object of the present disclosure is to provide rear interlock connectors for building blocks.

An object of the present disclosure is to provide building blocks for receiving rear interlock connectors.

An object of the present disclosure is to provide a kit comprising building blocks and rear interlock connectors.

An object of the present disclosure is to provide a method of building a structure with building blocks and rear interlock connectors.

An object of the present disclosure is to provide a structure constructed from building blocks and rear interlock connectors.

SUMMARY

In accordance with an aspect of the present disclosure, there is provided an interlock connector for interlocking building blocks for being assembled so as to provide a wall structure, the building blocks having respective front surfaces for defining a front façade of the wall structure and having respective rear surfaces with at least one respective horizontal groove, the interlock connector comprising: a first body for being inserted in the rear surface horizontal groove of a first building block; and a second body for being inserted in the rear surface horizontal groove of a second building block adjacent the first building block, wherein insertion of the first and second bodies in the respective rear surface horizontal grooves of the first and second building blocks provides for interlocking the first and second building blocks.

In an embodiment, the building blocks are arranged in vertical columns with one of the first or second building blocks being an upper building block and the other of the first or second building blocks being a lower building block, the upper building block resting on the lower building block. In an embodiment, when the interlock connector is mounted to the upper and lower building blocks, the first and second bodies provide for positioning the upper and lower blocks with respect to each other such that the front faces of the upper and lower blocks are offset with respect to one another. In an embodiment, the first and second bodies are pivotable between at least a first position and a second position, wherein when interlock connector is mounted to the upper and lower building blocks in the first position the respective front surfaces of the upper and lower blocks are evenly aligned with respect to one another and wherein when the interlock connector is mounted to the upper and lower building blocks in the second position the respective front faces of the upper and lower blocks are offset with respect to one another.

In an embodiment, the first and second building blocks are adjacently spaced apart from each other with each respective rear side surface thereof defining respective interfacing planes.

In an embodiment, the first and second bodies are pivotable with respect to each other.

In an embodiment, the at least one of the first and second bodies comprises a top and a bottom portion thereof, the top and bottom portions being pivotable with respect to one another about an eccentric pivot.

In an embodiment, the interlock connector further comprises a third body for interconnecting the first and second bodies. In an embodiment, the third body is removably mounted to the first and second bodies. In an embodiment, the first, second and third bodies are similarly constructed. In an embodiment, the third body provides for being connected to a third building block. In an embodiment, the third body provides for being connected to another interlock connector comprising first and second bodies. In an embodiment, the interlock connector further comprising a fourth interlock connector body connected to at least one of the upper and lower connector bodies.

In accordance with an aspect of the present disclosure, there is provided a kit for building a wall structure comprising: at least two building blocks for being assembled so as to provide the wall structure, the building blocks having respective front surfaces for defining a front façade of the wall structure and having respective rear surfaces with at least one respective horizontal groove; and at least one interlock connector as defined herein; wherein insertion of the first and second bodies in the respective rear surface horizontal grooves of the first and second building blocks provides for interlocking the first and second building blocks.

In accordance with an aspect of the present disclosure, there is provided a kit for building a wall structure comprising: at least two building blocks for being assembled in order to provide a wall structure, the building block comprising top and bottom surfaces, opposite lateral surfaces, a front surface for defining a front façade of the wall structure, and a rear surface comprising an upper horizontal groove positioned at least near the top surface and a lower horizontal groove positioned at least near the bottom surface, the upper and lower horizontal grooves respectively extending towards each of the opposite lateral surfaces; and at least one interlock connector for being received by at least one of the upper and lower horizontal grooves, wherein when stacking a plurality of the building blocks in a vertical column the distance between the upper and lower horizontal grooves of a given block is similar to: (a) the distance between the upper horizontal groove of the given block and the lower horizontal groove of an upper block of the vertical column stacked directly on the given block; and (b) the distance between the lower horizontal groove of the given block and a lower block of the vertical column on which the given block is stacked directly on.

In accordance with an aspect of the present disclosure, there is provided a wall structure comprising: at least two building blocks being assembled so as to provide the wall structure, the building blocks having respective front surfaces for defining a front façade of the wall structure and having respective rear surfaces with at least one respective horizontal groove; and at least one interlock connector as defined herein; wherein of the first and second bodies in the respective rear surface horizontal grooves of the first and second building blocks provides for interlocking the first and second building blocks.

In accordance with an aspect of the present disclosure, there is provided a wall structure comprising: at least two building blocks being assembled in order to provide a wall structure, the building block comprising top and bottom surfaces, opposite lateral surfaces, a front surface for defining a front façade of the wall structure, and a rear surface comprising an upper horizontal groove positioned at least near the top surface and a lower horizontal groove positioned at least near the bottom surface, the upper and lower horizontal grooves respectively extending towards each of the opposite lateral surfaces; and at least one interlock connector being received by at least on of the upper and lower horizontal grooves, wherein when a plurality of the building blocks are stacked in a vertical column the distance between the upper and lower horizontal grooves of a given block is similar to: (a) the distance between the upper horizontal groove of the given block and the lower horizontal groove of an upper block of the vertical column stacked directly on the given block; and (b) the distance between the lower horizontal groove of the given block and a lower block of the vertical column on which the given block is stacked directly on.

In accordance with an aspect of the present disclosure, there is provided a building block for being assembled with like building blocks in order to provide a wall structure, the building block comprising: top and bottom surfaces; opposite lateral surfaces; a front surface for defining a front façade of the wall structure; and a rear surface comprising an upper horizontal groove positioned at least near the top surface and a lower horizontal groove positioned at least near the bottom surface, the upper and lower horizontal grooves respectively extending towards each of the opposite lateral surfaces and providing for receiving respective interlock connectors, each of the respective interlock connectors being mounted to another respective building block, wherein when stacking a plurality of the building blocks in a vertical column the distance between the upper and lower horizontal grooves of a given block is similar to: (a) the distance between the upper horizontal groove of the given block and the lower horizontal groove of an upper block of the vertical column stacked directly on the given block; and (b) the distance between the lower horizontal groove of the given block and a lower block of the vertical column on which the given block is stacked directly on.

In accordance with an aspect of the present disclosure, there is provided a method of building a wall structure comprising: providing at least two building blocks having respective front surfaces for defining a front façade of the wall structure and having respective rear surfaces with at least one respective horizontal groove; assembling the at least two building blocks so as to provide the wall structure; providing at least one interlock connector as defined herein; and mounting the at least one interlock connector to the at least two assembled building blocks by inserting the first and second bodies in respective rear surface horizontal grooves of the first and second building blocks provides for interlocking the first and second building blocks.

Other objects, advantages and features of the present disclosure will become more apparent upon reading of the following non-restrictive description of non-limiting illustrative embodiments thereof, given by way of example only with reference to the accompanying drawings.

BRIEF DESCRIPTION OF THE DRAWINGS

In the appended drawings, where like reference numerals denote like elements throughout and in where.

DETAILED DESCRIPTION OF ILLUSTRATIVE EMBODIMENTS

Generally stated and in accordance with an embodiment, there is provided an interlock connector interlocks building blocks that are assembled so as to provide a wall structure. The building blocks have respective front surfaces for defining a front façade of the wall structure and respective rear surfaces with at least one respective horizontal groove. The interlock connector comprises first and second bodies. The first body is inserted in the rear surface horizontal groove of a first building block. The second body is inserted in the rear surface horizontal groove of a second building block adjacent the first building block. Insertion of the first and second bodies in the respective rear surface horizontal grooves of the first and second building blocks provides for interlocking the first and second building blocks.

With reference to the appended drawings, illustrative embodiments of the present disclosure will be described herein so as exemplify the disclosure and by no means limit the scope thereof.

Figure 1:
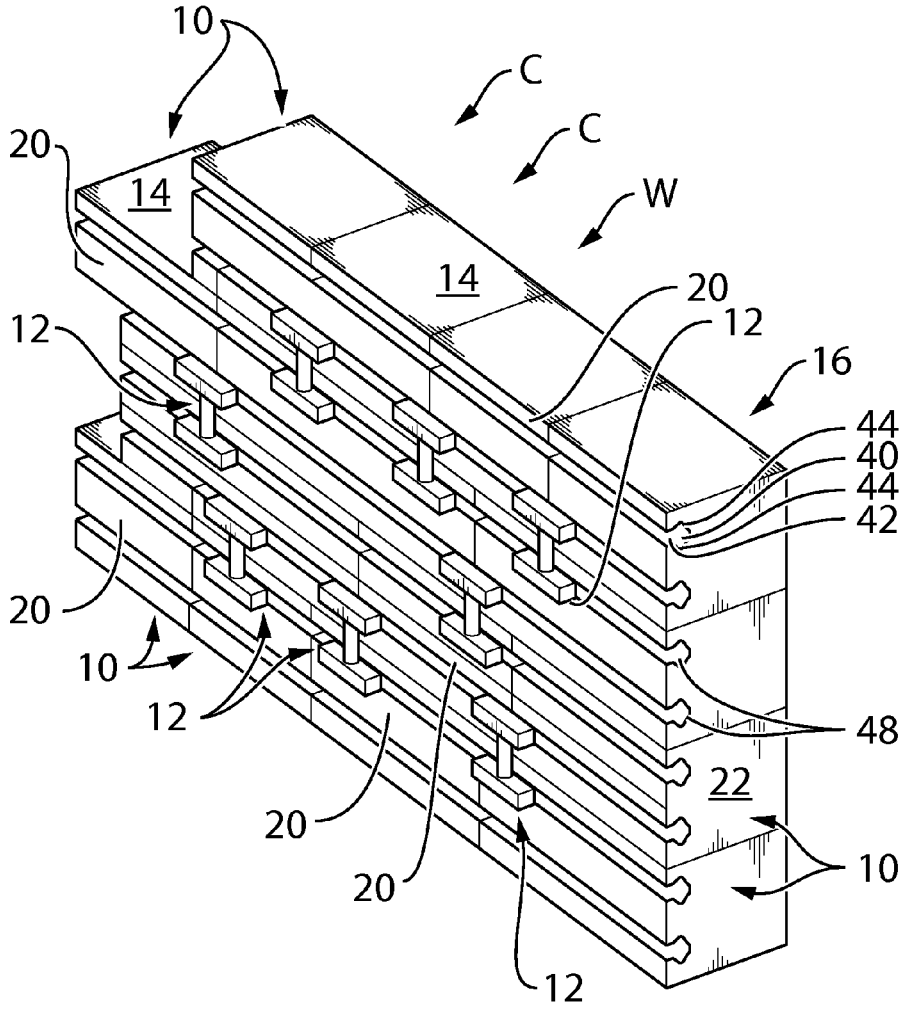
FIG. 1 is a rear perspective view of a wall structure comprising a plurality of budding blocks and interlock connectors in accordance with a non-restrictive illustrative embodiment of the present disclosure.

FIG. 1 shows a wall structure W comprising a plurality of building blocks 10 interlocked with interlock connectors 12. The building block 10 comprise respective top surfaces 14, bottom surfaces 16 (see FIG. 5), front surfaces 18 (see FIG. 7), rear surfaces 20, and opposite lateral surfaces 22. The blocks 10 are stacked together in side by side columns C.

Figure 5:
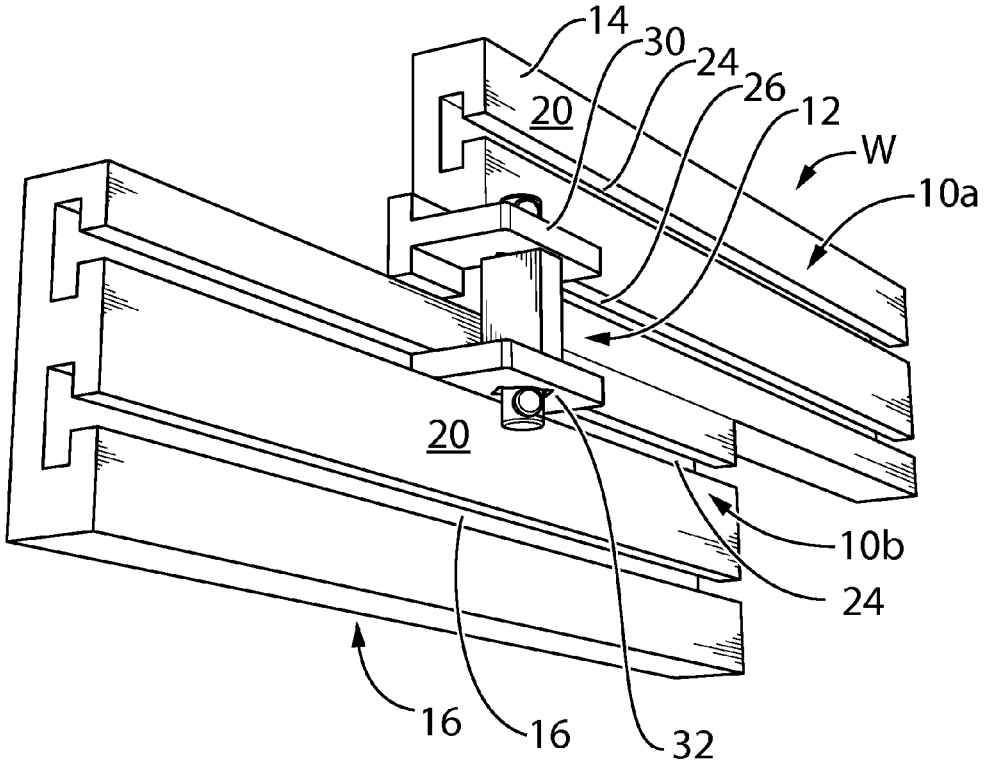
FIG. 5 is a rear perspective view of a wall structure comprising upper and lower building blocks and the interlock connector of FIG. 2 in accordance with a non-restrictive illustrative embodiment of the present disclosure.
Figure 6:
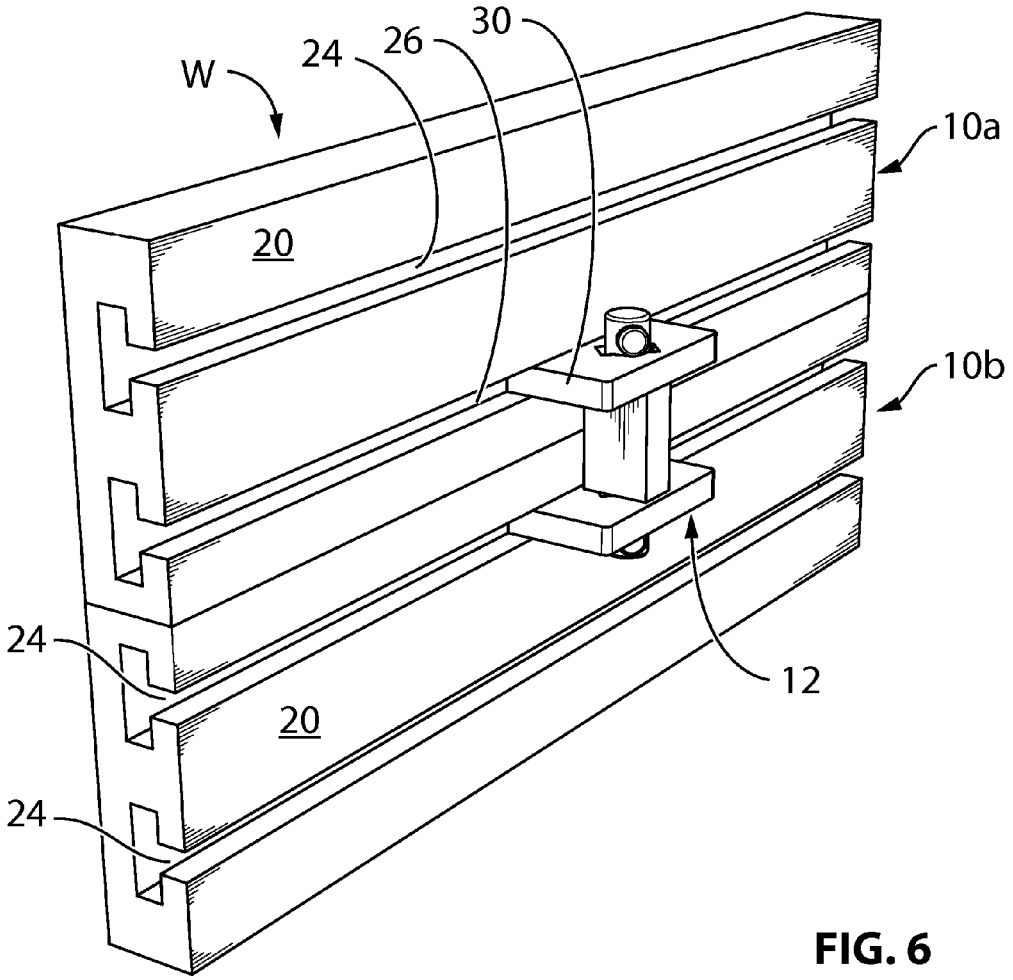
FIG. 6 is another rear perspective view of a wall structure comprising upper and lower building blocks and the interlock connector of FIG. 2 in accordance with a non-restrictive illustrative embodiment of the present disclosure.

As better shown in FIGS. 5 and 6, the rear surface 20 of each block 10 comprises an upper horizontal groove 24 formed near the top surface 14 and a lower horizontal groove 28 formed near the bottom surface 16

Figure 2:
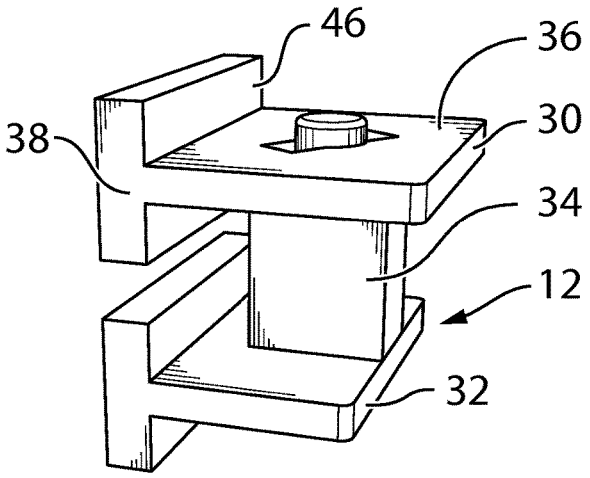
FIG. 2 is a perspective view of an interlock connector in accordance with a non-restrictive illustrative embodiment of the present disclosure.
Figure 3:
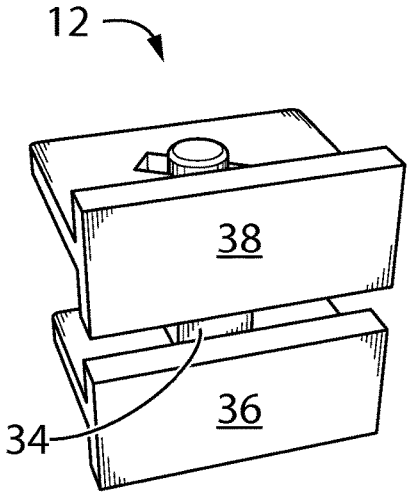
FIG. 3 is a front view of the interlock connector of FIG. 2.
Figure 4:
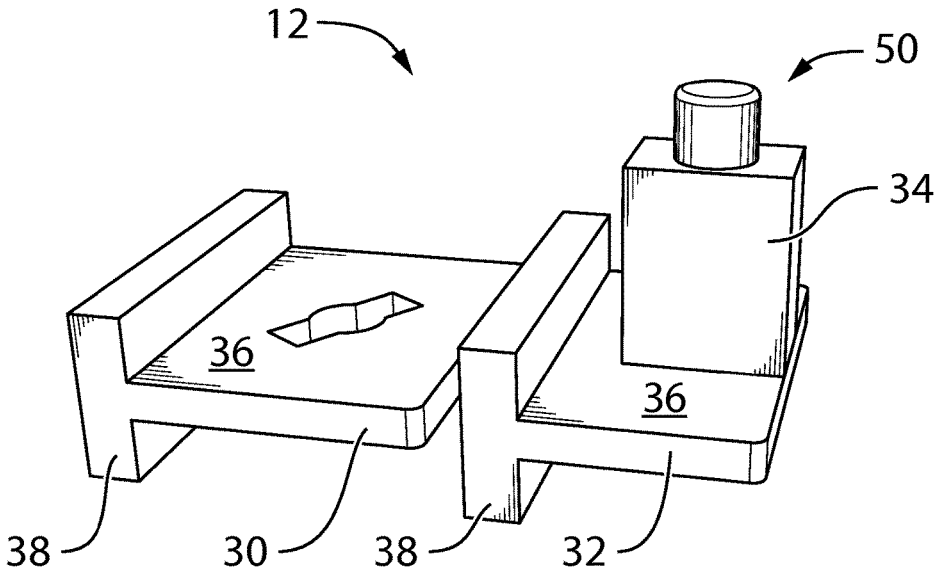
FIG. 4 is a perspective view of the interlock connector of FIG. 2 in a disassembled position.

With reference to FIGS. 2, 3 and 4, the interlock connector 12 includes two bodies 30 and 32 respectively mounted to a support member 34 in the form an elongated median member interposed therebetween which spaces bodies 30 and 32 apart. Each of the bodies 30 and 32 is a T shaped body including plank 36 directly mounted on the elongate median member 34 and a front flange 38 mounted to the front plank 36. In this example bodies 30 and 32 are similarly configured and referred herein for convenience only as the first body 30 and the second body 32. Of course that the terms "first" and "second" are interchangeable. The bodies 30 and 32 are connected to the median member 34 at different positions along their respective planks 36 thereby causing their respective front flanges 38 to be offset relative to one another. In this example, the front 38 of the first body 30 is positioned slightly behind the front 38 of the second body 32.

In this example, the first body 30 is inserted in the upper groove 24 and the second body 32 is inserted in the lower groove 26.

As shown in FIG. 1 grooves 24 and 26 are T shaped grooves having an inner groove portion 40 that is wider than the outer groove portion 42 thus forming inner wall shoulders 44 that interfere with the inner wall side 46 (see FIG. 2) of the front flanges 38 when the bodies 30 or 34 are inserted therein with the plank extending through the outer groove portion 42. Thus the bodies 30 and 23 are inserted and removed from grooves 26 and 28 by sliding them in and out of the side slots 48 (see FIG. 1) formed on the lateral surfaces 22 of the blocks 10. Hence, the interlock connector 12 cannot be pulled out from the opening defined in the rear surface 20 of the block defined by the outer groove portion 44. Thus the present interlock connector 12 and blocks 10 allow for locking the blocks together in a fully interlocked wall structure W.

Figure 7:
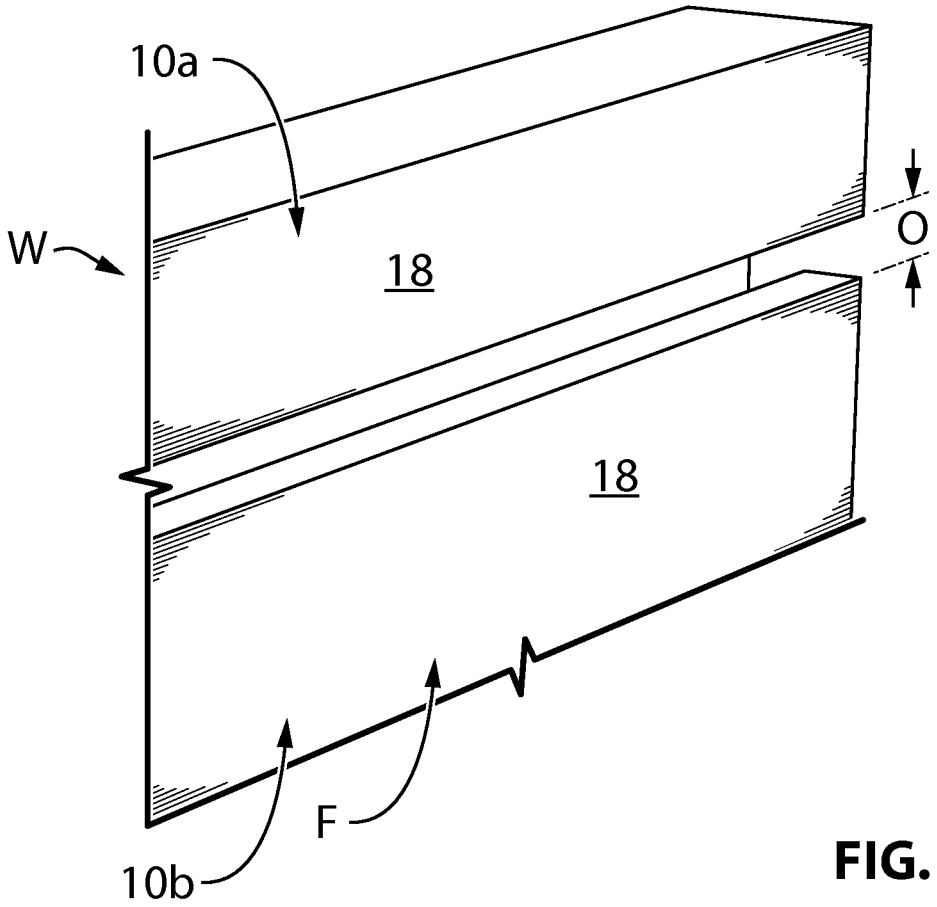
FIG. 7 is a front perspective view of the wall structure of FIG. 6.

As explained above the first and second bodies 30 and 32 are offset and therefore when the interlock connector 12 is mounted an upper block 10*a* stacked on a lower block 10*b* as shown in FIGS. 5, 6 and 7, causing an offset O between the front faces 18 of the upper and lower blocks 10*a* and 10*b* that define the façade F of the wall structure W.

Figure 8:
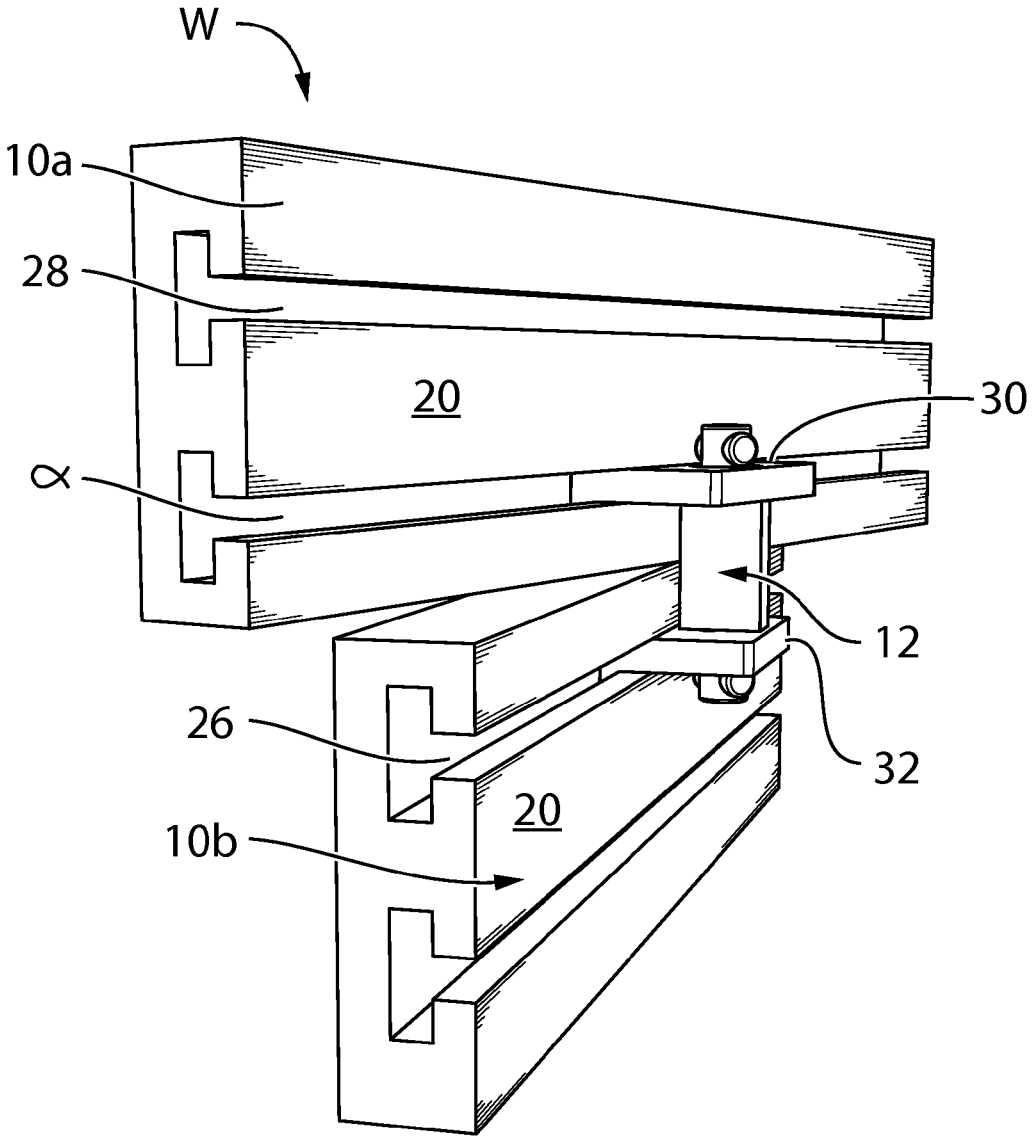
FIG. 8 is a further rear perspective view of a wall structure comprising upper and lower building blocks and the interlock connector of FIG. 2 in accordance with a non-restrictive illustrative embodiment of the present disclosure.
Figure 9:
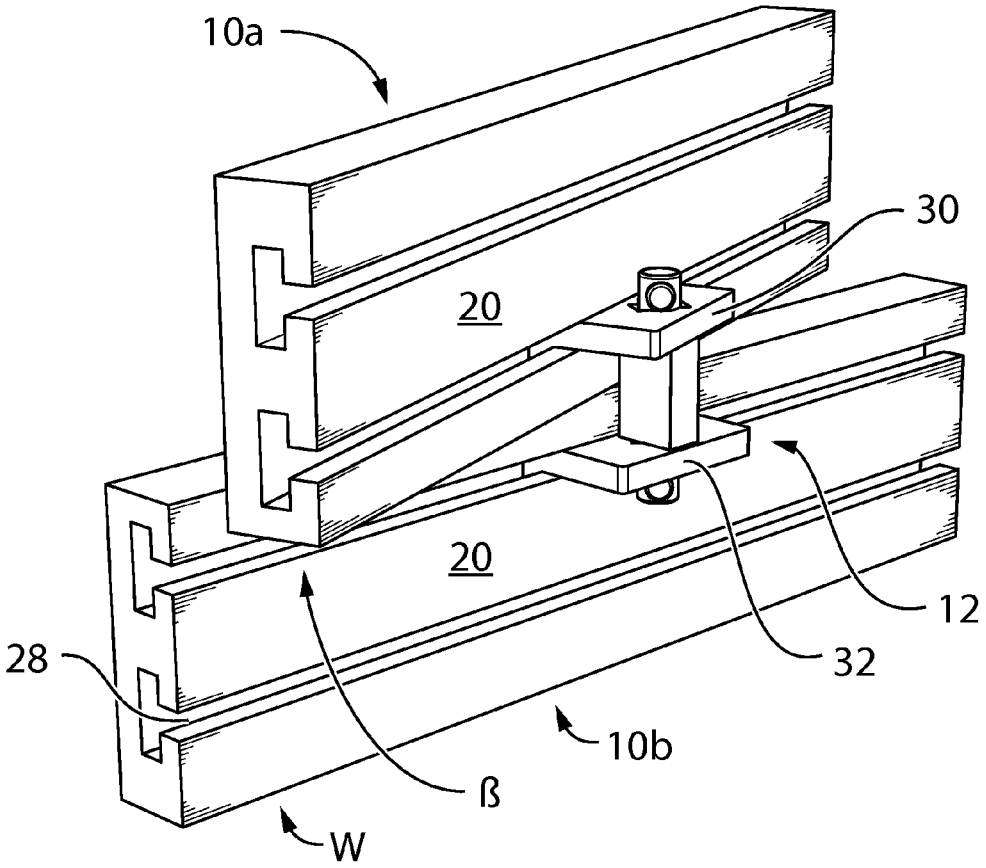
FIG. 9 is yet another rear perspective view of a wall structure comprising upper and lower building blocks and the interlock connector of FIG. 2 in accordance with a non-restrictive illustrative embodiment of the present disclosure.

In another body embodiment shown in FIGS. 8 and 9, the first and second bodies 30 and 32 respectively are pivotable with respect to one another at thereby allowing to connect the blocks 10*a* and 10*b* along various angles such as $\alpha$ and $\beta$ with respect to one another. Turning to FIG. 4, the first body 30 is mounted to the median member 34 about a pivot element 50.

As shown in FIGS. 5, 6, 8 and 9 a wall structure W is formed by connecting the interlocking connector to the upper groove 24 of a lower block 10*b* and to the lower groove 26 of the upper block 10*a*.

In an embodiment, the distance between the upper groove 24 of a lower block 10*b* and the lower groove 26 of the upper block 10*a* is constant within a stacked column C. In an embodiment, the distance between the upper and lower grooves 24 and 26 of the same block 10 are the same as the distance between the upper groove 24 of this block 10 and the lower groove 26 of an upper block 10*a* stacked thereon and the distance between the lower groove 26 of this block 10 and the upper groove 24 of a lower block 10*b*, this block 10 is stacked on.

Figure 10:
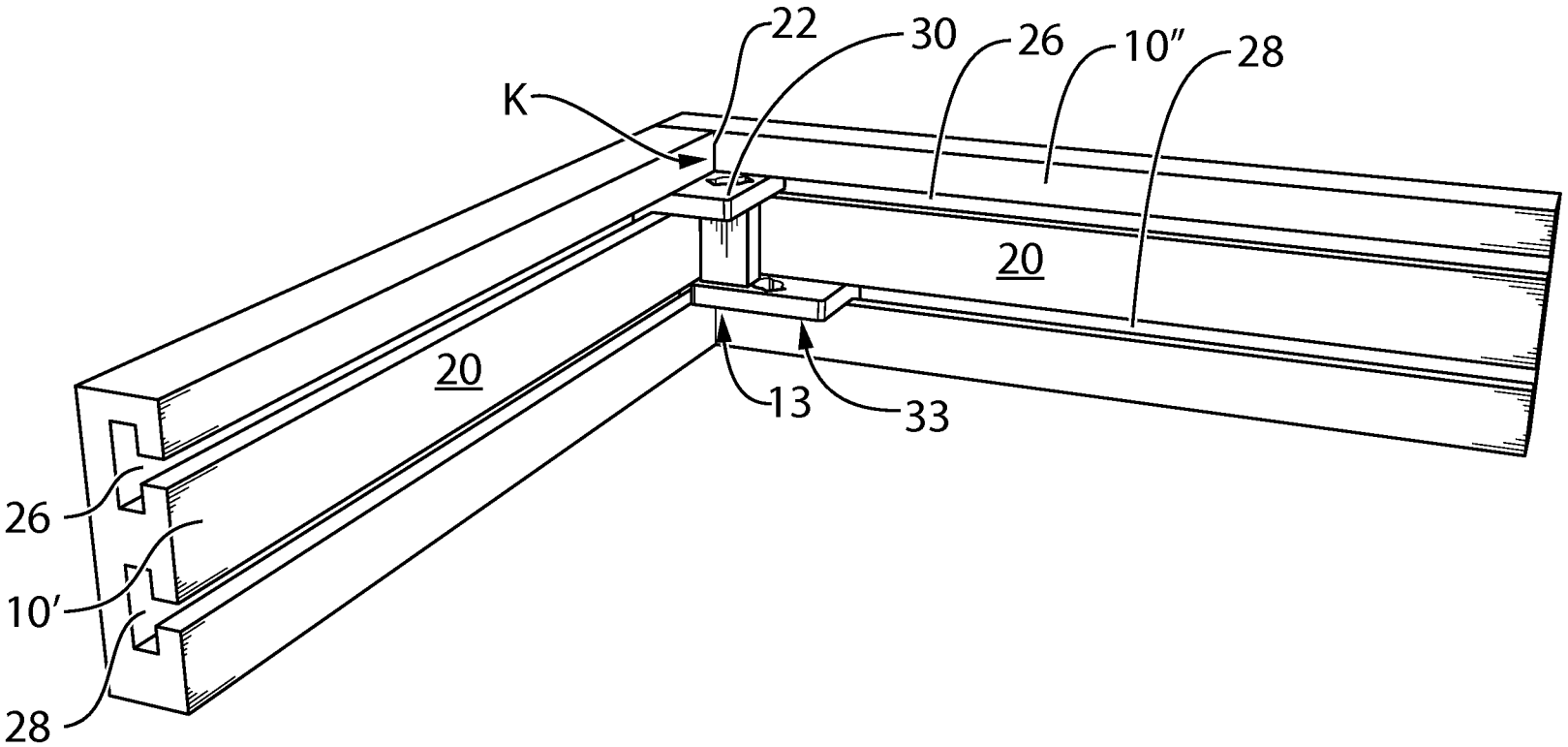
FIG. 10 is a rear perspective view of wall structure corner comprising lateral adjacent building blocks and the interlock connector of FIG. 2 in accordance with a non-restrictive illustrative embodiment of the present disclosure.

FIG. 10 shows a wall structure W comprising two adjacent blocks 10' and 10" that form an angle or corner K there between with the lateral side 22 of one adjacent block 10" engaging the rear surface 20 of the other adjacent block 10'. The Interlock connector 13 is mounted to the adjacent blocks 10' and 10". The first body 30 of the interlock connector 13 is mounted to the upper grooves 4 of both blocks 10' and 10" and the second body 33 of the interlock connector 13 is mounted to the of one adjacent block and the second body 33 is mounted to the lower grooves 26 of the blocks 10' and 10".

Figure 11:
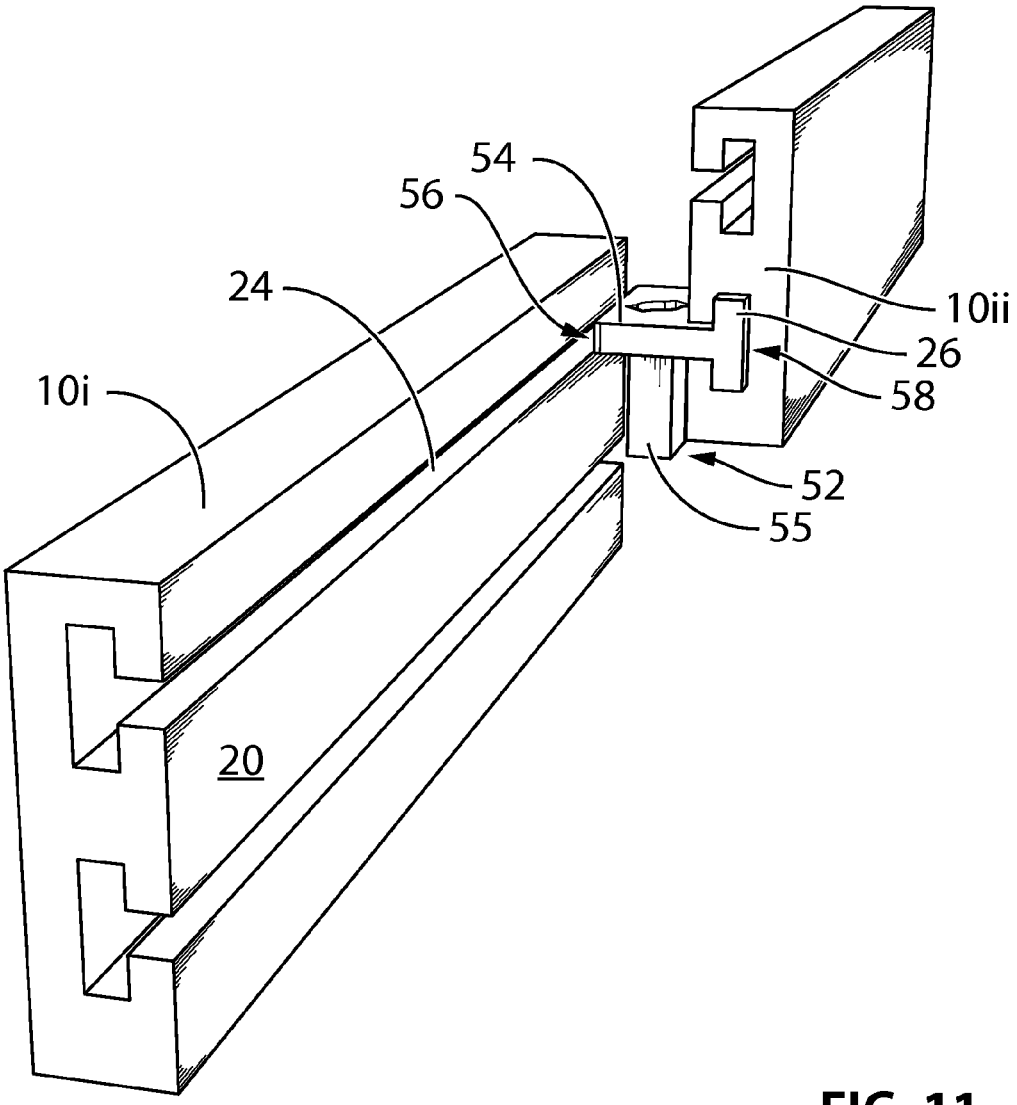
FIG. 11 is a lateral view of two building blocks interlocked at their respective rear surfaces with the interlock connector of FIG. 2 in accordance with a non-restrictive illustrative embodiment of the present disclosure.

FIG. 11 shows two adjacent blocks 10*i* and 10*ii* with their respective rear surfaces interfacing. An interlock connector 52 comprising a first body 54 mounted to a support 55 and having two connectable ends 56 and 58 is interposed between and mounted to the blocks 10*i* and 10*ii* with one end 56 mounted to the upper groove of one block 101 and the other end 58 mounted to the lower groove of the other block 10*ii*.

Figure 12:
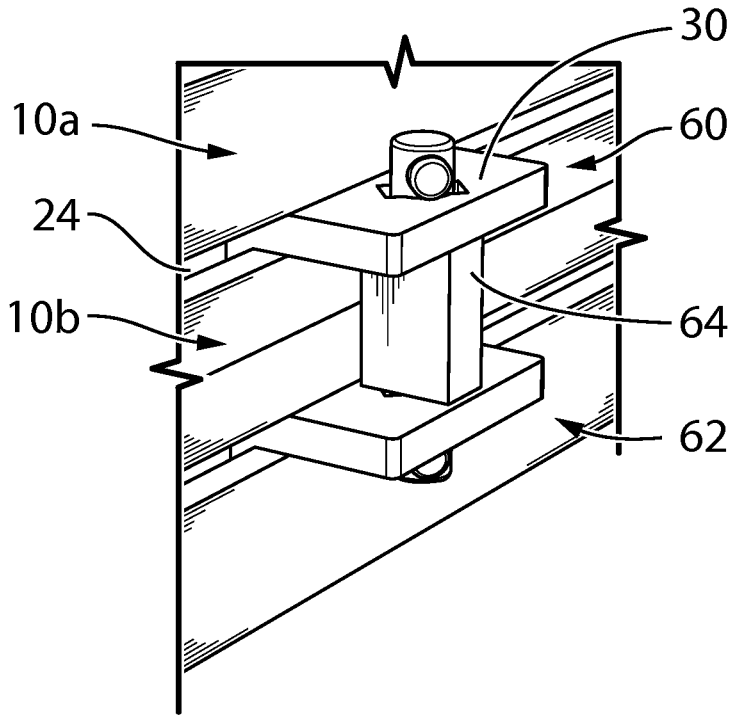
FIG. 12 is a rear perspective view of a wall structure comprising upper and lower building blocks and an interlock connector in accordance with another non-restrictive illustrative embodiment of the present disclosure.

FIG. 12 shows an interlock connector 60 comprising a first body 30 mounted and a second body 62 both of which are mounted to a support 64. The second body 62 is pivotally mounted to the support 64 and configured as described in U.S. Pat. No. 7,328,535 which is incorporated herein by reference in its entirety. Thus the second body 64 provides for varying degrees of offsetness between upper and lower blocks 10*a* and 10*b*.

Figure 13:
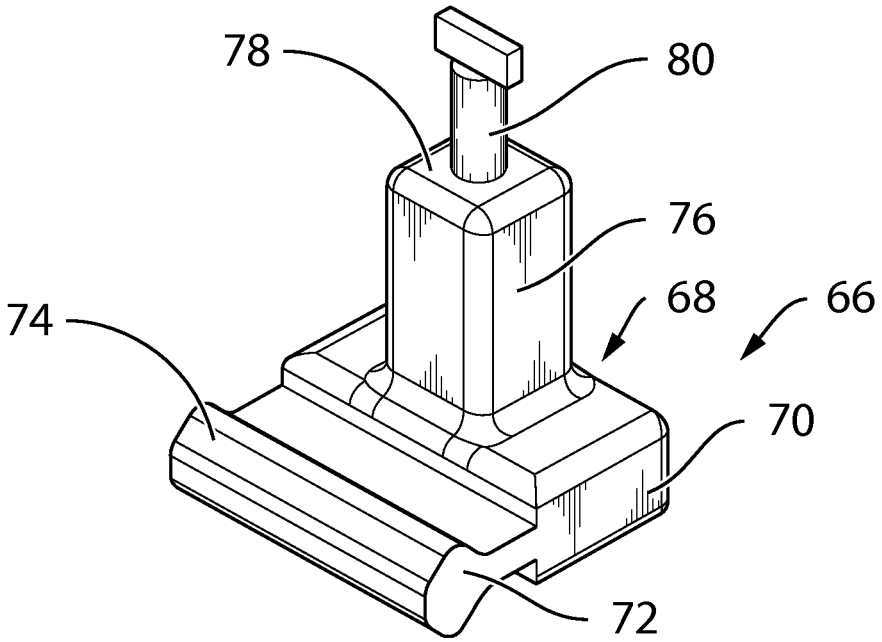
FIG. 13 is a perspective view of an interlock connector in accordance with a further non-restrictive illustrative embodiment of the present disclosure.

FIG. 13 shows main body 66 of an interlock connector comprising a connector body 68 with a base portion 70 from which protrudes an extension 72 that carries an elliptical or cylindrical thicker section 74 for being retained within the grooves of blocks as explained herein. A support section 76 is upstanding from the base body 70 and includes at it top end 78 a pivot element 80 for receiving an additional connector body.

Figure 14:
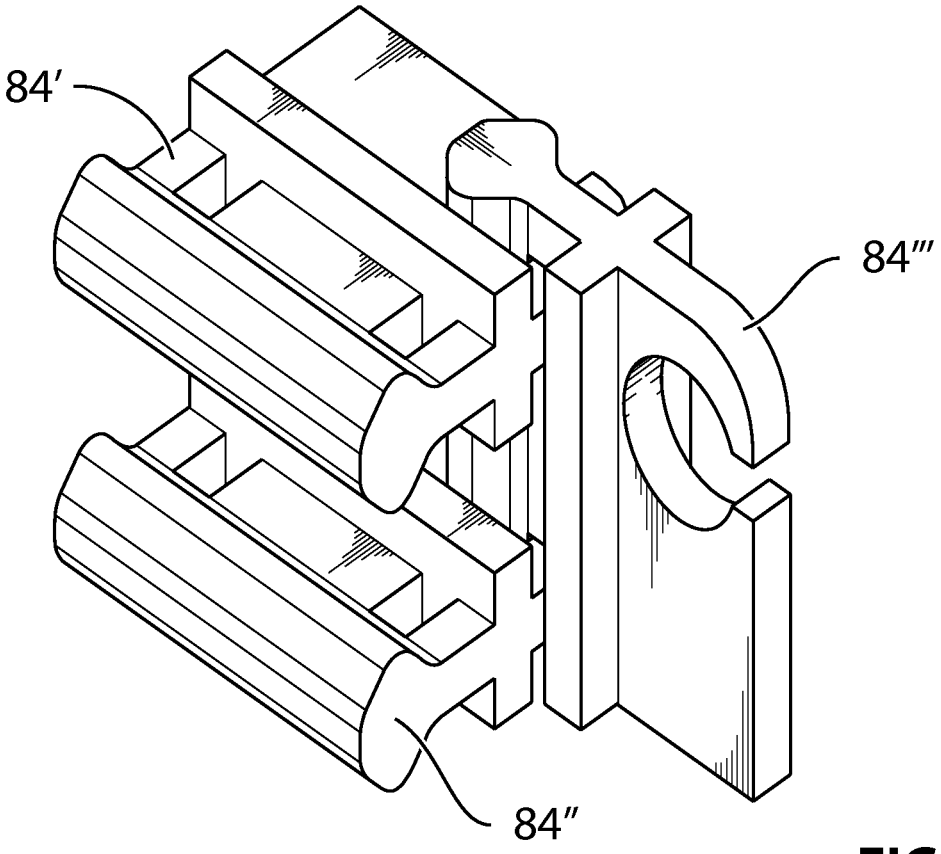
FIG. 14 is a perspective view of an interlock connector in accordance with yet another nonrestrictive illustrative embodiment of the present disclosure.
Figure 15:
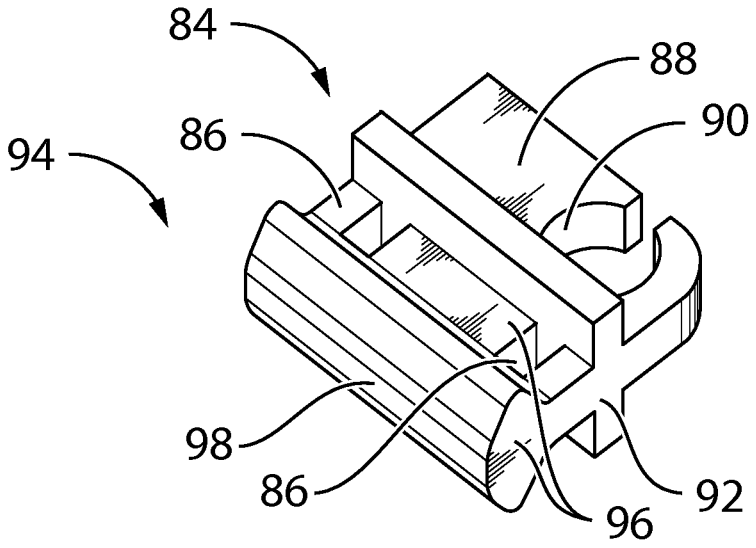
FIG. 15 is a perspective view of a connector body of the interlock connector of FIG. 14.
Figure 16:
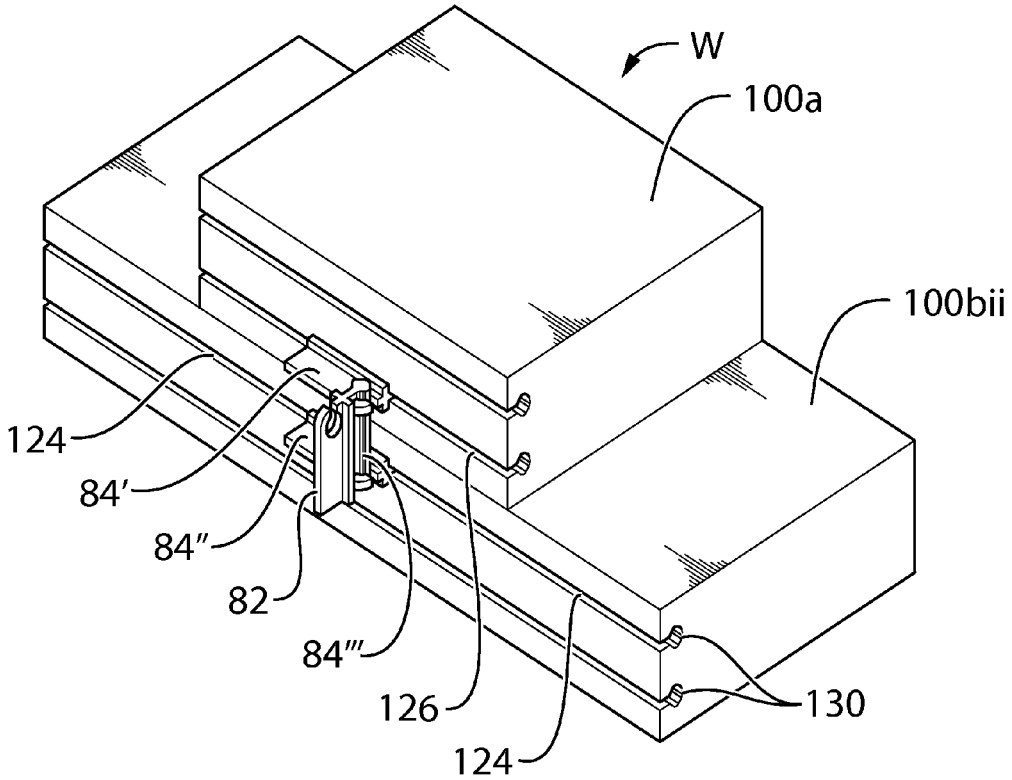
FIG. 16 is a rear perspective view of a wall structure comprising an upper building block and a pair of adjacent lower building blocks and the interlock connector of FIG. 14 in accordance with a non-restrictive illustrative embodiment of the present disclosure.

Turning now to FIGS. 14, 15 and 16, there is provided an interlock connector 82 comprising first and second bodies 84' and 84" mounted to a support body 84", the foregoing bodies 84', 84" and 84" are all similarly constructed and are generally denoted 84 in FIG. 15. Each body 84 includes rear portion 88 with an ring opening 90, a middle portion 92 defined by a vertical plank and a front portion 94 including an extension 96 protruding from the vertical plank and carrying a thicker elliptical or cylindrical section 98 for being received within a block groove as described herein. The extension 96 defines two openings 86.

The first and second bodies 84 and 84" are pivotally mounted to the support body 84'" about its cylindrical section 98. More specifically, the rings 9—of each body 84' and 84" respectively engage the extension 98 of body 84" via its openings 86.

The interlock connector 82 provides for providing a wall structure W shown in FIG. 16 having an upper block 100*a* mounted on two adjacent lower blocks 100*bi* and 100*bii*. The first body 84' is mounted to the lower groove 126 of the upper block 100*a* and the second body 84" is mounted to the upper grooves of both the adjacent lower blocks 100*bi* and 100*bii*. The grooves 124 and 126 are correspondingly configured to the shape of section 98. Side slots 130 are also provided in the blocks for inserting and removing the connector bodies.

Figure 17:
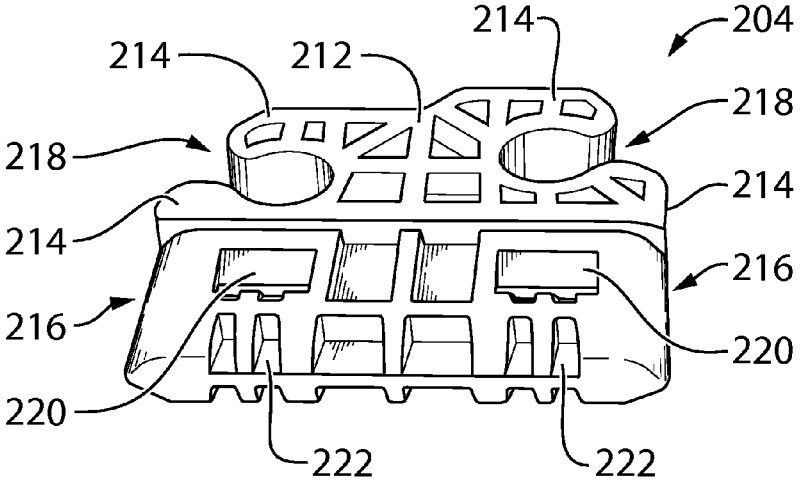
FIG. 17 is a top perspective view of an interlock connector body in accordance with another non-restrictive illustrative embodiment of the present disclosure.
Figure 18:
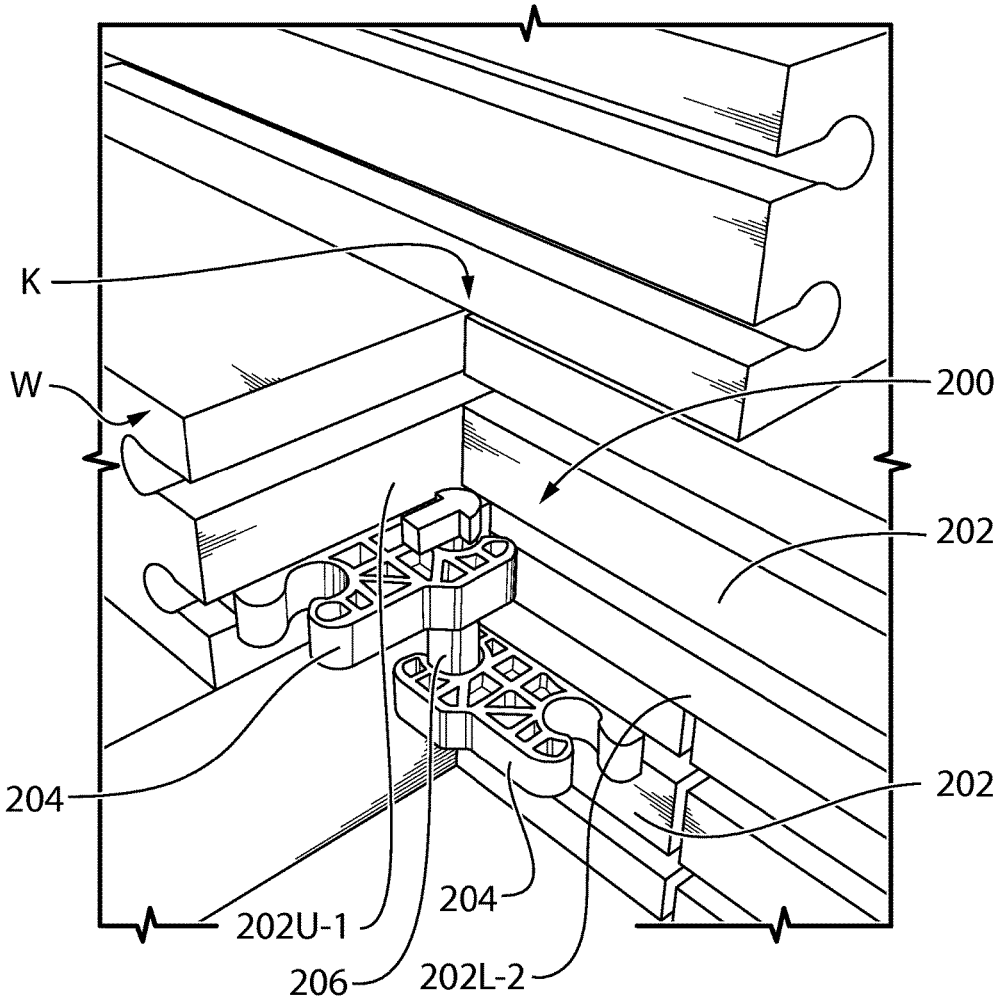
FIG. 18 is rear perspective view of a wall structure defining a corner structure and comprising adjacent upper and lower building blocks connected together via an interlock connector formed of two interconnected connector bodies, similar to the one shown in FIG. 17 in accordance with a further non-restrictive illustrative embodiment of the present disclosure.
Figure 19:
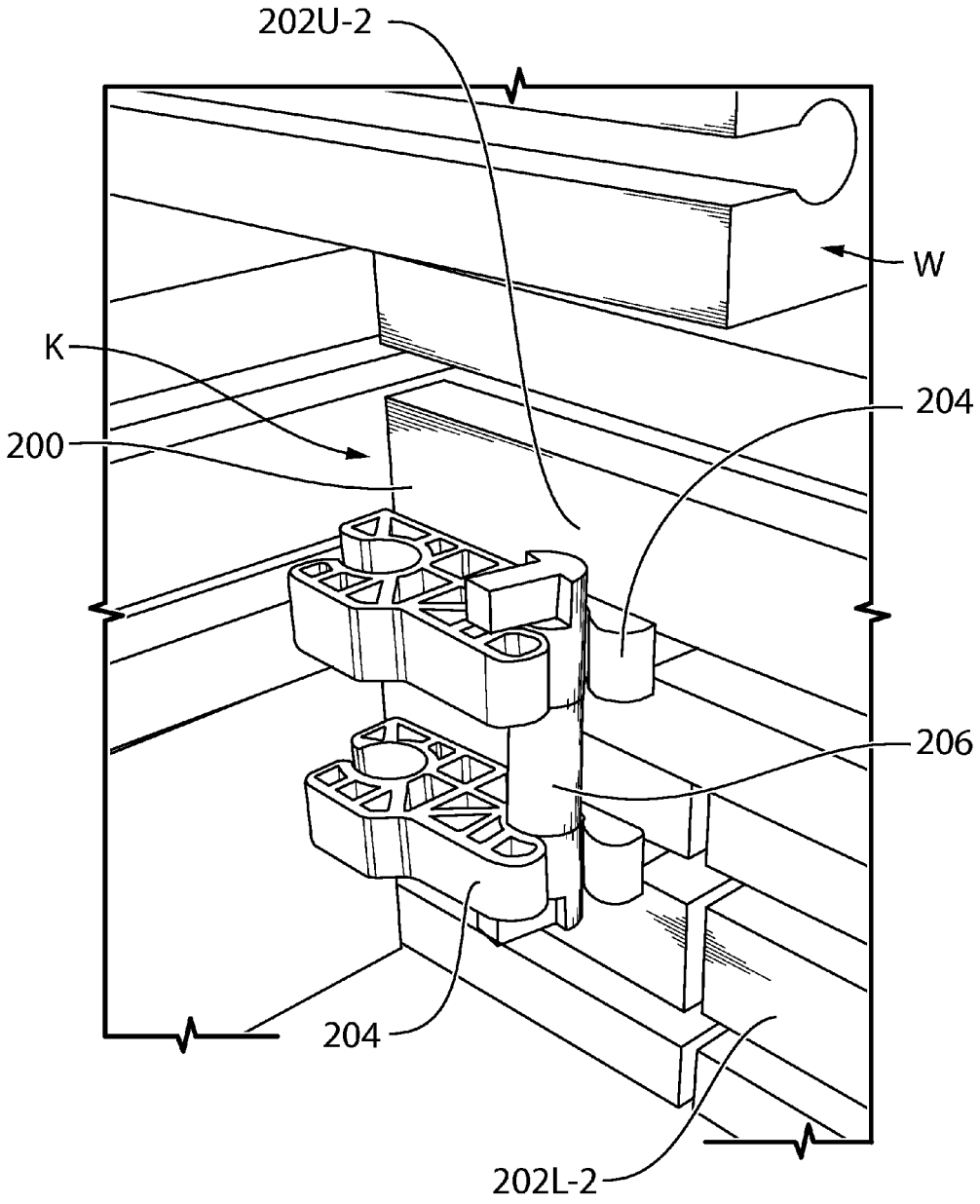
FIG. 19 is a rear perspective view of the wall structure of FIG. 18 showing the interlock connector connecting vertically stacked upper and lower building books.

Turning now to FIGS. 17, 18, 19, and 20 show a connector 200 for being mounted and interconnecting building blocks 202 stacked and assembled together to define a wall structure W defining a corner area K. The connector 200 includes similar upper and lower connector bodies 204 pivotably connected together via third body 206 in the form of a rod. Each body 204 comprises a connecting section 208 fitted within the respective rear horizontal groove 210 of each respective building block 202. Furthermore, the respective rear section 212 of each body 204 includes resilient fingers 214 at each lateral side 216 thereof defining an opening 218 for removably receiving the rod 206 and thus forming the connector. Of course, a plurality of connector bodies 204 can be similarly mounted to a longer rod. FIG. 18 shows the connector 200 interconnecting an upper block 202U-1 of one side of corner area K and a lower block 202L-2 whereas FIG. 19 shows the connector interconnecting an upper block 202U-2 and the lower block 202L-2 on the same side of the corner area K. As such, the bodies 204 pivot about rod 206 between the positions of FIGS. 18 and 19.

Figure 20:
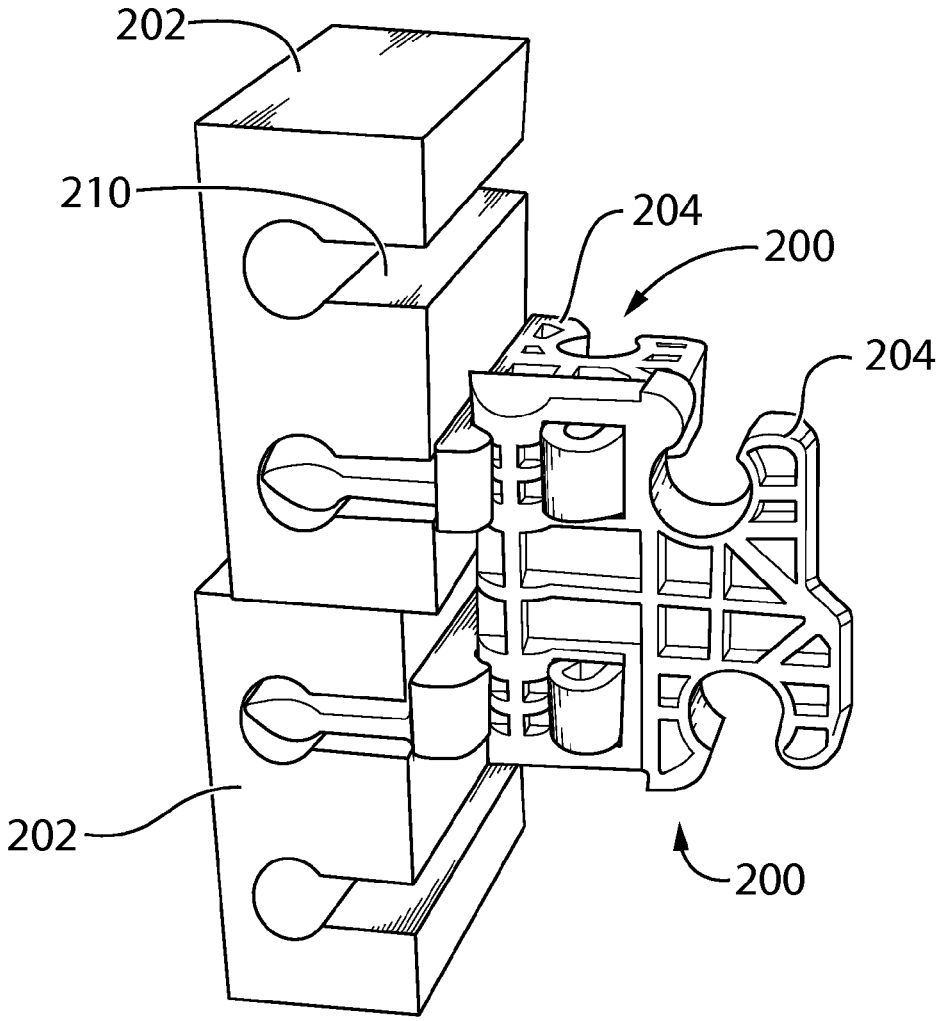
FIG. 20 is a perspective view of an interlock connector formed of three removably interconnected interlock connector bodies similar to the one shown in FIG. 17 mounted to upper and lower building blocks.

FIG. 20 shows an interlock connector 200' formed of three interconnected connector bodies 204. As shown in FIG. 17, the connecting section defines opening 220 further forming staff sections 222 at each lateral side 216 thereof. As such a given body 204*v* can be vertically interconnected to the upper and lower bodies 204*u* and 204*l* with the respective fingers 214 thereof clamping a respective staff section 222.

Figure 21:
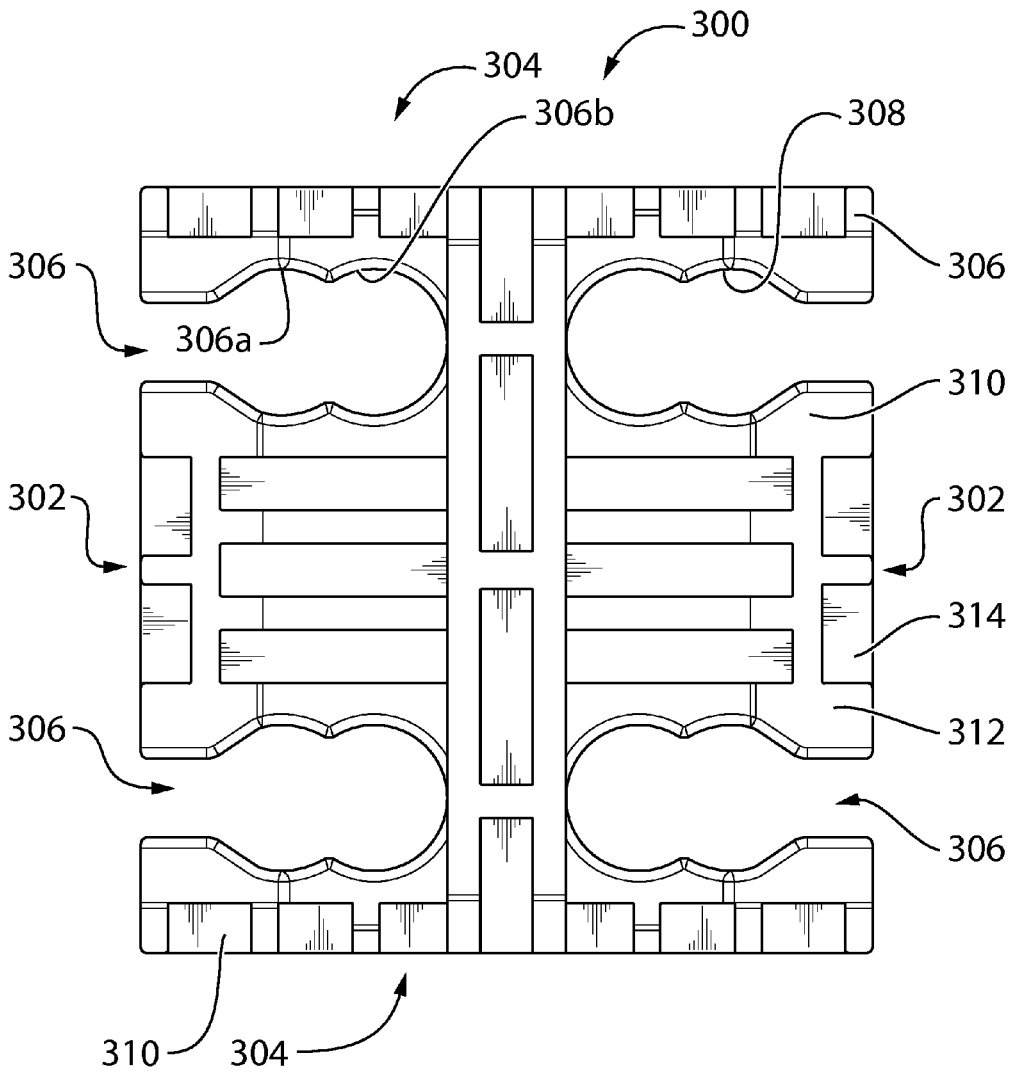
FIG. 21 is a top plan view of an interlock connector body in accordance with another non-restrictive illustrative embodiment of the present disclosure.

FIG. 21 shows a connector body 300 comprising a flat rectangular configuration defining opposite and similarly configured connecting sections 302 and opposite lateral side 304. Each connecting section 302 defines an opening or notch 306 near each lateral side 304. The openings 306 have an narrower outer portion 306*a* and a wider inner portion 306*b* defined by inner walls 308 which form deformable finger portions 310 for mutually engaging or clamping the similarly constructed connector bodies 300. The connector section 302 includes a median portion 312 positioned between the notches 306 and having a cylindrical like external edge 314.

Figure 22:
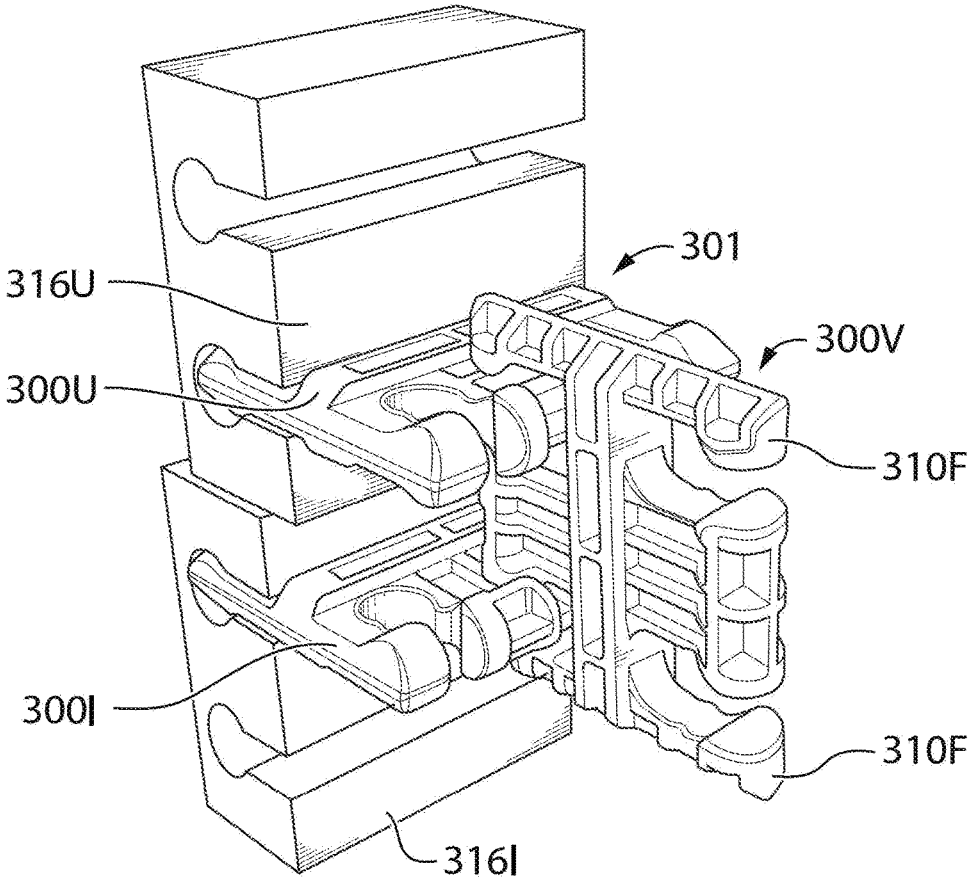
FIG. 22 is a perspective view of an interlock connector formed of three removably interconnected interlock connector bodies similar to the one shown in FIG. 21 mounted to upper and lower building blocks.

FIG. 22 shows an interlock connector 301 comprising three interconnected bodies such as body 300, namely upper body 300*u*, lower body 300*l* and vertical body 300*v* interconnecting the upper and lower bodies, 300*u* and 300*l* respectively. The interlock connector 301 is mounted to and interconnects stacked upper and lower blocks 316*u* and 316*l*.

The connecting section 302 of the upper body 300*u* is fitted within the horizontal groove 314 on the rear face 316 of the upper block 312*u*. The connecting section 302 of the lower body 300*l* is fitted within the horizontal groove 314 on the rear face 316 of the lower block 312*u*.

In FIG. 22, the vertical body 300*v* is mounted to the upper and lower bodies 300*u* and 300*l* by having its finger portions 310 clamp the respective median portions 312 of each body 300*u* and 300*l*. The body 300*v* projects rearwardly from the bodies 300*u* and 300*l*. As such, the free finger portions 310F of the vertical body 300*v* can clamp additional bodies 300 which are connected to other building blocks (not shown) spaced apart from the building blocks 300*u* and 300*l* shown here and having a rear side or face that defines a plane that interfaces with the plane defined by the rear faces 316 of building blocks 300*u* and 300*l*.

Figure 23:
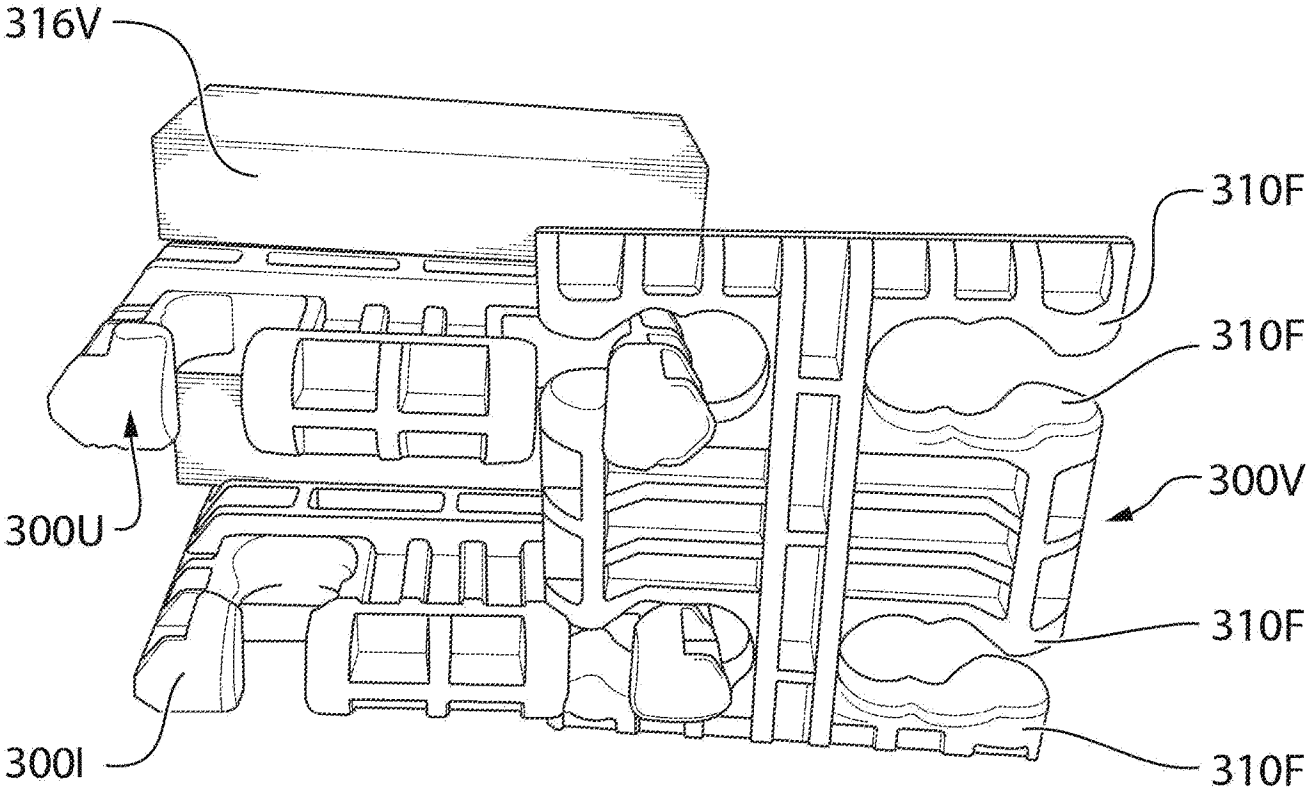
FIG. 23 is a perspective view of an interlock connector formed of three removably interconnected interlock connector bodies similar to the one shown in FIG. 21 mounted to upper and lower building blocks in a different position than that shown in FIG. 22.

In FIG. 23, the vertical body is mounted to the upper and lower bodies 300*u* and 300*l* by having its finger portions 310 clamp respective finger portions 310 of each body 300*u* and 300*l*. The body 300*v* projects laterally from the bodies 300*u* and 300*l*. As such, the free finger portions 310F of the vertical body 300*v* can clamp additional bodies 300 which are connected to other building blocks (not shown) positioned side by side with the building blocks 300*u* and 300*l*.

Figure 24:
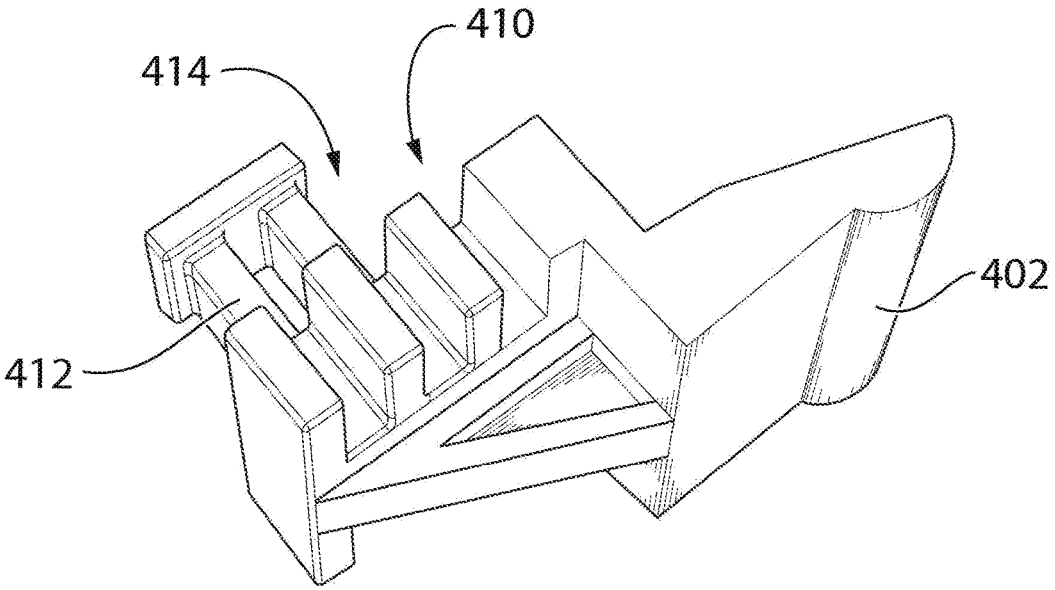
FIG. 24 is a lateral bottom perspective view connector body in accordance with a further non-restrictive illustrative embodiment of the present disclosure.
Figure 25:
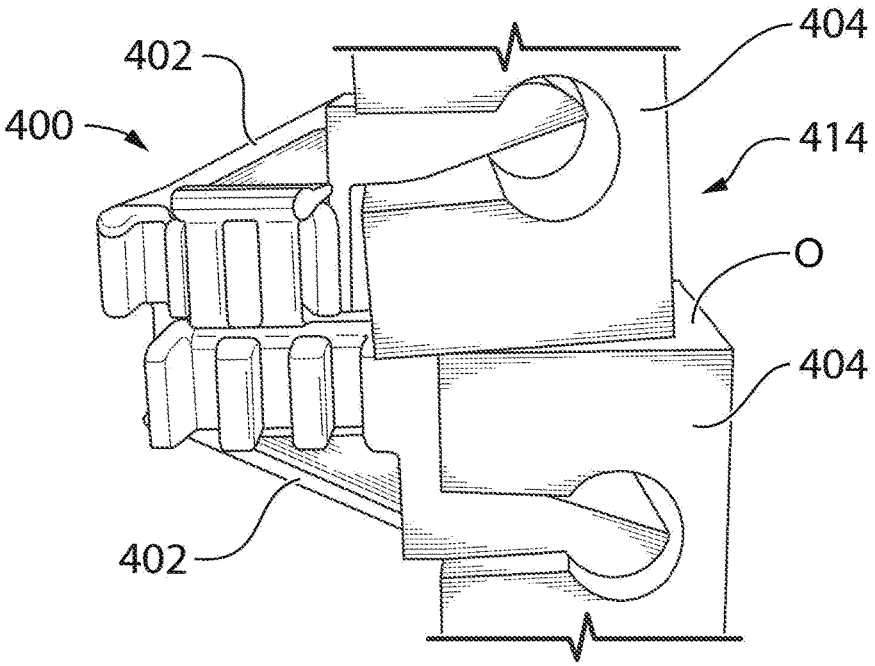
FIG. 25 is lateral view of view of an interlock connector formed of upper and lower removably interconnected interlock connector bodies, each being similar to the one shown in FIG. 24 mounted to respective upper and lower building blocks.

FIGS. 24 and 25 show an interlock connector 400 comprising a pair of similarly constructed interconnected connector bodies 402. Each connector body 402 comprises a front connecting portion 404 for being inserted within the respective rear horizontal groove 406 of vertically stacked building blocks 408. The connector bodies 402 also include rear mating portions 410 having fingers 412 and notches 414 for being connected to each other at different positions along their mating portions 410 in order to create an offset between their connecting portions 404 which provides a complementary offset O between the front faces 414 of the stacked blocks 408.

In general the backs provided herein include one or more horizontal groove for receiving connectors to retain the upper and lower blocks and the side by side blocks.

The present disclosure provides a variety of interlock connectors such as, without limitation: interlock connectors with pivoting connector bodies for providing offsets between interconnected or interlocked blocks; fixed non-pivotable connectors; interlock connectors that are locked with a pin or screw element; and the like.

The interlock connectors and blocks described herein provide, without limitation the following: building wall structures without adhesives; providing angles between multiple wall sections; providing round wall structures; locking wall corners.

The interlock connector and blocks provided herein can be used in a variety of fields.

The various characteristics, features and configurations of the various embodiments described herein can be combined in a variety of ways and such it is to be understood that the disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation, Hence, although the present disclosure has been described hereinabove by way of embodiments thereof, it can be modified, without departing from the spirit, scope and nature of the claims.

What is claimed is:

1. An interlock connector for interlocking building blocks for being assembled so as to provide a wall structure, the building blocks having respective front surfaces for defining a front façade of the wall structure and having respective rear surfaces with at least one respective horizontal groove, the building blocks being arranged with at least a first building block being adjacent to a second building block, the interlock connector comprising:

three separate connector bodies being interconnected, wherein of one of the three similar and separate connector bodies acts as a backing connector body connectively receiving a first one and a second one of the other two of the three separate connector bodies;

each of the connector bodies having a rectangular configuration defining opposite connecting sections and opposite lateral sides, each connecting section defining an opening near each lateral side thereby defining a median section therebetween and a finger portion at each lateral side being spaced apart from the median section, the median section having a cylindrical external edge, each of the openings having a relatively narrower outer portion thereof and a relatively wider inner portion thereof, each opening being circumscribed by inner walls which form deformable clamping elements;

the backing connector body defining at one of the connecting sections thereof the openings comprising first and second openings, the first opening receiving one connecting section of the first connector body being clamped thereby by the clamping elements defined by the first opening, the other connecting section of the first connector body providing for being inserted in the rear surface horizontal groove of the first building block, the second opening receiving one connecting section of the second connector body being clamped thereby by the clamping elements defined by the second opening, the other connecting section of the second connector body providing for being inserted in the rear surface horizontal groove of the second building block.

2. An interlock connector according to claim 1, wherein the building blocks are arranged in vertical columns with one of the first or second building blocks being an upper building block and the other of the first or second building blocks being a lower building block, the upper building block resting on the lower building block.

3. An interlock connector according to claim 2, wherein when the interlock connector is mounted to the upper and lower building blocks, the first and second bodies provide for positioning the upper and lower blocks with respect to each other such that the front faces of the upper and lower blocks are offset with respect to one another.

4. An interlock connector according to claim 1, wherein the backing connector body provides for being connected to a third building block of the building blocks.

5. An interlock connector according to claim 1, wherein the backing connector body provides for being connected to another interlock connector comprising first and second bodies.

6. An interlock connector according to claim 1, further comprising a fourth body connected to the backing connector body.

7. A kit for building a wall structure comprising:

at least two building blocks for being assembled so as to provide the wall structure, the building blocks having respective front surfaces for defining a front façade of the wall structure and having respective rear surfaces with at least one respective horizontal groove; and at least one interlock connector as defined in claim 1;

wherein insertion of the first and second connector bodies in the respective rear surface horizontal grooves of the first and second building blocks provides for interlocking the first and second building blocks.

8. A wall structure comprising:

at least two building blocks being assembled so as to provide the wall structure, the building blocks having respective front surfaces for defining a front façade of the wall structure and having respective rear surfaces with at least one respective horizontal groove; and at least one interlock connector as defined in claim 1;

wherein insertion of the first and second connector bodies in the respective rear surface horizontal grooves of the first and second building blocks provides for interlocking the first and second building blocks.

9. A method of building a wall structure comprising:

providing at least two building blocks having respective front surfaces for defining a front façade of the wall structure and having respective rear surfaces with at least one respective horizontal groove;

assembling the at least two building blocks so as to provide the wall structure;

providing at least one interlock connector as defined in claim 1; and mounting the at least one interlock connector to the at least two assembled building blocks by inserting the first and second connector bodies in respective rear surface horizontal grooves of the first and second building blocks provides for interlocking the first and second building blocks.

* * * * *